United States Patent [19]

Satomi

[11] 4,095,980

[45] Jun. 20, 1978

[54] DRUM CLEANING METHOD AND APPARATUS FOR ELECTROSTATOGRAPHY

[75] Inventor: Toyokazu Satomi, Tokyo, Japan

[73] Assignee: Ricoh Company, Ltd., Tokyo, Japan

[21] Appl. No.: 693,242

[22] Filed: Jun. 4, 1976

[30] Foreign Application Priority Data

Jun. 11, 1975 Japan ..... 50-70461

[51] Int. Cl.[2] ..... G03G 21/00

[52] U.S. Cl. ..... 96/1.4; 96/1 R; 355/15; 15/256.52

[58] Field of Search ..... 355/15; 96/1.4, 1 R; 134/1; 15/1.5 R, 256.5, 256.51, 256.52, 256.53; 118/652, 70, 104, 203, 204

[56] References Cited

U.S. PATENT DOCUMENTS

| | | | |
|---|---|---|---|
| Re. 28,566 | 10/1975 | Yang | 355/15 |
| 3,667,840 | 6/1972 | Engel et al. | 355/15 |
| 3,848,994 | 11/1974 | Fraser | 15/256.52 |
| 3,879,123 | 4/1975 | Fisher | 355/15 |
| 3,994,725 | 11/1976 | Volkers | 96/1.4 |
| 4,006,987 | 2/1977 | Tomono et al. | 355/15 |

OTHER PUBLICATIONS

*Research Disclosure* 13605, Electrographic Cleaning Apparatus, Aug. 1975.

*Primary Examiner*—L. T. Hix
*Assistant Examiner*—W. J. Brady
*Attorney, Agent, or Firm*—Frank J. Jordan

[57] ABSTRACT

The entire surface of a photoconductive drum is developed with a toner substance after imaging, and a copy sheet is fed into contact with the drum for transfer of the toner image thereto. If the copy sheet is smaller than the maximum image area of the drum, toner from the portion of the drum outside of the edges of the copy sheet will be transferred to transfer and separating rollers and the like to contaminate the same if not removed. The invention provides a brush which slidably contacts the exposed back surface of the copy sheet and the portion of the drum outside the edges of the copy sheet to remove the toner from this portion prior to separating the copy sheet from the drum.

30 Claims, 2 Drawing Figures

DRUM CLEANING METHOD AND APPARATUS FOR ELECTROSTATOGRAPHY

BACKGROUND OF THE INVENTION

The present invention relates to a method and apparatus for cleaning toner substance from the areas of a photoconductive drum outside the edges of an undersized copy sheet prior to removing the copy sheet from image transferring contact with the drum.

It is desirable that a dry process electrostatic copying machine be able to accommodate the largest commercial size of copy sheets. However, it is also desirable that the copying machine be able to operate using smaller sizes of copy sheets. Such a copying machine generally comprises a rotary photoconductive drum, a charger to apply an electrostatic charge to the drum and imaging means to radiate a light image of an original document onto the drum so that an electrostatic image of the original document is formed on the drum due to conduction in light areas of the image. A powdered toner substance is then applied to the drum to produce a toner image, and a copy sheet is pressed into contact with the drum to transfer the toner image to the copy sheet. An electric potential is preferably applied to the sheet to attract the toner particles from the drum. The copy sheet is then removed from the drum and the toner image is thermally fixed thereto.

If the original document and thereby a copy sheet utilized to produce a copy of the document is smaller than the maximum size, there will be areas outside the edges of the useful image area on the drum. A certain amount of toner substance will adhere to these areas during the developing step. If not removed, this toner substance will contaminate a transfer roller, a separating roller and the like and also the back surfaces of copy sheets of larger size used in a subsequent copying operation.

Various methods have been proposed in the prior art to overcome this problem, which include:

a. synchronizing the engagement of a separating roller with the copy sheet;
b. changing the polarity of a bias voltage applied to a transfer roller;
c. performing charging, developing and other operations only on the actual image area of the drum; and
d. radiating light on the areas of the drum outside the image area to dissipate the electrostatic charge thereon.

These various methods all require intricate and expensive mechanisms, and are accurate in only one dimension. The difficulty of accurately synchronizing these prior art operations increases with the peripheral speed of the drum, and are extremely difficult to perform in high speed copying machines.

Another difficulty is encountered in cases in which the copy sheet is smaller than the original document, since the size of the original document is generally utilized for synchronization purposes by these prior systems.

SUMMARY OF THE INVENTION

It is an object of the present invention to provide a method of removing toner substance from areas of a photoconductive drum outside of an image area which overcomes the drawbacks of the prior art.

It is another object of the present invention to provide apparatus embodying the above method.

It is another object of the present invention to provide a method and apparatus utilizing a brush which contacts an exposed back surface of a copy sheet adhered to a photoconductive drum and areas of the drum outside the copy sheet to remove toner substance from said areas.

Other objects, together with the foregoing, are attained in the embodiments described in the following description and illustrated in the accompanying drawings.

DESCRIPTION OF THE PREFERRED EMBODIMENTS

While the method and apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
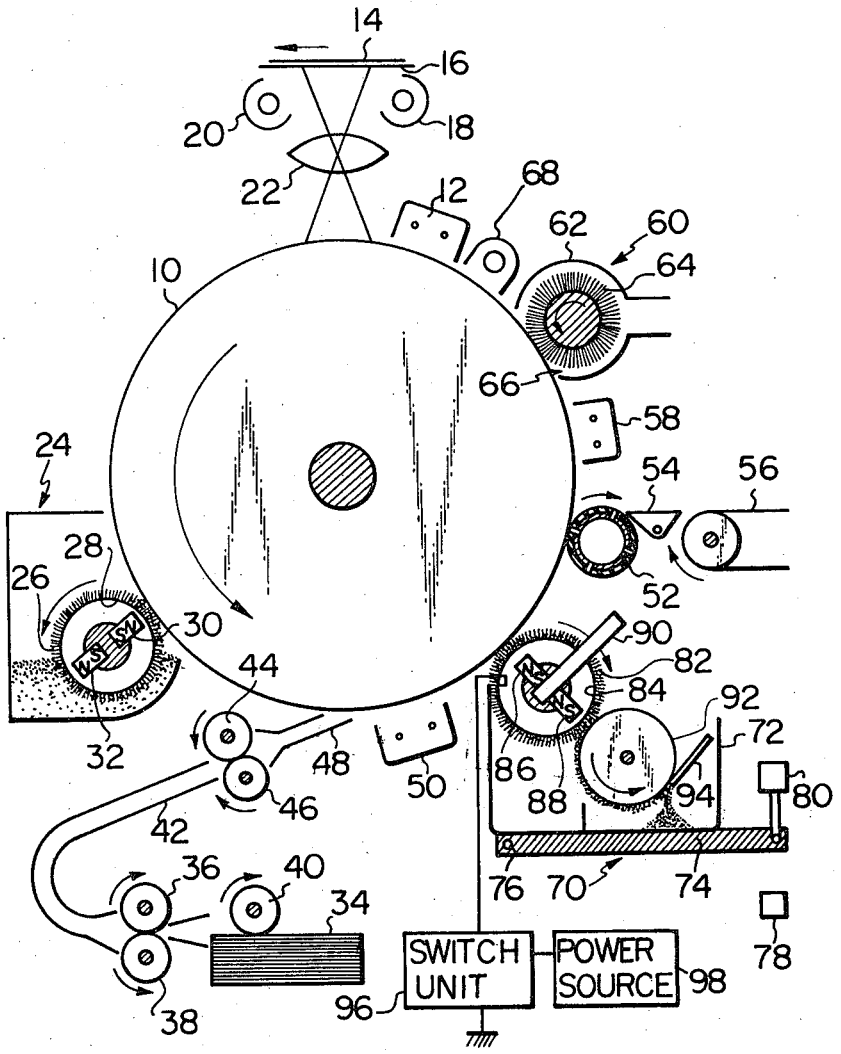
FIG. 1 is a schematic view of a first embodiment of the invention.

In FIG. 1, a photoconductive drum 10 is rotated counterclockwise at a constant speed by a drive motor which is not shown. A corona charging unit 12 is disposed adjacent to the drum 10 to apply an electrostatic charge to the surface thereof. An original document 14 is placed face down on a transparent platen 16 and illuminated by lamps 18 and 20. A converging lens 22, in conjunction with leftward movement of the platen 16 and document 14, causes a light image of the document 14 to be radiated onto the surface of the drum 10, with the speed of movement of the platen 16 being equal to the surface speed of the drum 10 for a full scale reproduction. The light areas of the image radiated on the drum 10 cause the drum 10 to locally conduct and dissipate the charge induced by the charging unit 12 to form an electrostatic image on the drum 10. The dark areas of the electrostatic image retain a high electrostatic charge whereas the electrostatic charge in the light areas is considerably less. A developing unit 24 contains a toner substance comprising, for example, black particles mixed with a magnetic carrier. A magnetic brush 26 is partially immersed in the toner substance and applies the toner substance to the surface of the photoconductive drum 10 to produce a visible or toner image from the electrostatic image. The toner particles preferably have a charge opposite to that of the drum 10 so that the particles are attracted to and adhere to the dark areas of the electrostatic image. The magnetic brush 26 comprises a non-magnetic cylinder 28 driven for counterclockwise rotation in close proximity to the drum 10. Magnets 30 and 32 are fixed in position inside the cylinder 28 in such a manner that a pole (shown as a north pole) of the magnet 30 having a polarity opposite to the polarity of the toner particles is adjacent to the drum 10.

In this manner, the cylinder 28 picks up toner particles from the bottom of the unit 24 and a hill of toner particles is created on the cylinder 28 between the magnet 30 and the drum 10 which brushingly contacts the drum 10 to develop the electrostatic image on the drum 10.

Copy sheets 34 are provided in a stack and are fed one by one into the nip of feed rollers 36 and 38 by a feed roller 40. The feed rollers 36 and 38 feed the sheets 34 through a guide 42 into the nip of feed rollers 44 and 46 which feed the sheets 34 through a guide 48 into contact with the drum 10. The feed rollers 44 and 46 are actuated in such a manner that the leading edges of the sheets 34 are aligned with the leading edge of the toner image on the drum 10.

A transfer charging unit 50 is arranged to apply a charge to the exposed back surfaces of the copy sheets 34 of the same polarity as the charge on the drum 10 to attract the toner particles from the drum 10 to the copy sheets 34. The copy sheets 34 are carried by the drum 10 to a separating roller 52 which removes the sheets 34 from the drum 10 and, in conjunction with a separating pawl 54, feeds the sheets 34 onto a conveyor 56 which leads to a thermal fixing unit which is not shown. The toner image is fixed to the sheets 34 and the sheets 34 are discharged from the apparatus.

The separating roller 52 is preferably formed of a rigid cylinder coated with an elastic material such as rubber. Radial holes may be formed from an evacuated hollow center of the separating roller 52 to the exterior thereof so that the sheets 34 are forcibly removed from the drum 10 by means of vacuum.

A corona discharge unit 58 dissipates the electrostatic charge on the drum 10 and a cleaning unit 60 removes any toner substance from the surface of the drum 10. The cleaning unit 60 preferably comprises a casing 62 through which a rotary brush 64 protrudes to brushingly contact the drum 10 through an opening 66 in the casing 62. Similar to the separating roller 52, the brush 64 may have an evacuated hollow center with radial holes leading from the center external of the brush 64. The interior of the casing 62 may also be evacuated in such manner as to convey the toner substance removed from the drum 10 to a container for recycling.

A light source 68 irradiates the surface of the drum 10 to dissipate any residual electrostatic charge thereon.

A cleaning unit 70 constituting a novel feature of the present invention comprises a cleaning tank 72 which is fixed to an arm 74 which is pivotal about a shaft 76. The arm 74 and tank 72 are normally urged by gravity to a lowered position (not illustrated) to rest on a stop block 78. In the lowered position the cleaning unit 70 is spaced from the drum 10 and thereby inoperative. An electrical solenoid 80 is provided to raise the cleaning unit 70 to an operative position in engagement with the drum 10 when energized.

A magnetic brush 82 is disposed in the upper part of the tank 72 to slidingly contact the drum 10. The magnetic brush 82 has a length equal to the length of the drum 10 so as to be engagable with the entire surface of the drum 10. The magnetic brush 82 comprises a non-magnetic cylinder 84 which is rotated clockwise in this exemplary embodiment. Magnets 86 and 88 are fixedly mounted in the cylinder 84 in such a manner that the north pole of the magnet 86 faces the drum 10. A lever 90 is fixed to the magnets 86 and 88 so that the magnets 86 and 88 can be reversed so that the south pole of the magnet 88 faces the drum 10. This makes the cleaning unit 70 adaptable to a copying machine in which the charging unit 12 induces either a positive or negative charge to the drum 10. The magnetic brush 82 serves to remove toner substance from the surface of the drum 10. A predetermined amount of toner substance is allowed to accumulate on the cylinder 84. Due to the action of the magnet 86 a hill of toner substance is formed between the cylinder 84 and the drum 10 which brushingly contacts the drum 10 to remove toner therefrom.

A cylinder or roller 92 is provided in the tank 72 below the cylinder 84. A small clearance is provided between the cylinder 84 and the roller 92 so that excess toner substance is removed from the cylinder roller by the roller 92. The rollr 92 is shown as being rotated counterclockwise. A scraper 94 removes the toner substance from the roller 92 which accumulates in the tank 72. This toner substance is preferably recycled.

The cylinder 84 may be a allowed to electrically float or a switch unit 96 may be provided to connect the cylinder 84 to ground or to a power source 98 which imparts an electric potential to the cylinder 84 having a polarity opposite to the toner particles. Alternatively, the power source 98 may impart an alternating electric voltage to the cylinder 84.

The solenoid 80 is energized to move the cleaning unit 70 to its operative position when the copy sheets 34 are smaller than the maximum size copy sheets which the apparatus can accomodate. The drum 10 has a maximum image surface area which is substantially equal to the surface area of the maximum size copy sheets although practically, the drum 10 is designed to have a maximum image surface area which is slightly greater than the surface area of the maximum size copy sheet. When the copy sheets 34 are used having a smaller surface area, portions of the drum 10 do not contact the sheets 34 when the sheets 34 are pressed against the drum 10 for transfer of the toner image. Since the entire surface of the drum 10 is developed by the developing unit 24, a significant amount of toner substance adheres to these portions. If this tone is not removed from the drum 10, it will adhere to the separating roller 52 to contaminate the same. When larger size copy sheets are subsequently used, the toner substance on the separating roller 52 will contaminate the backs of these sheets.

The magnetic brush 82 ensures that all toner substance is removed from these non-transfer areas of the drum 10 regardless of the size of the copy sheets 34 since it engages with not only these areas but with the back of the copy sheets 34. Due to the force of the magnet 86, no toner substance will be applied to the exposed back surface of the sheets 34 by the magnetic brush 82, but the magnetic brush 82 will effectively remove all toner substance from the non-transfer portions. This ensures that no toner substance will be transferred to the transfer roller 52 to contaminate the same.

An automatic device (not shown) may be provided to actuate the solenoid 80 in a copying process in which more than one copy is produced from a single electrostatic image on the drum 10. If the developing step is performed only once for a plurality of copies, the cleaning unit 70 is moved by the solenoid 80 to its operative position only once following the developing step to minimize dissipation of the electrostatic image.

Whereas the cleaning unit 70 is shown and described as comprising the magnetic brush 82, the magnetic brush 82 may be replaced by a brush made of fur or the like if desired.

Another feature of the embodiment shown in FIG. 1 is that since the copy sheets 34 are adhered to the drum 10 by means of the static electric potential on the drum 10, the sliding contact of the magnetic brush 82 on the exposed surfaces of the sheets 34 reduces the static electric force between the drum 10 and the sheets 34 so that the sheets 34 can be easily removed from the drum 10 by the separating roller 52. This is especially effective if the brush 82 is grounded or applied with a potential opposite to that of the drum 10. The applied potential is determined in consideration of the electrical resistance of the copy sheets 34, the temperature and humidity and other relevant factors. Typical values of this potential may range from 100VDC to 1000VDC. In cases in which a DC potential might weaken the adhesion of the toner image to the copy sheets 34, an AC voltage or a combined AC and DC voltage may be applied to the magnetic brush 82. An electric potential may also be applied to the roller 92 of a polarity to attract toner substance from the magnetic brush 82.

Figure 2:
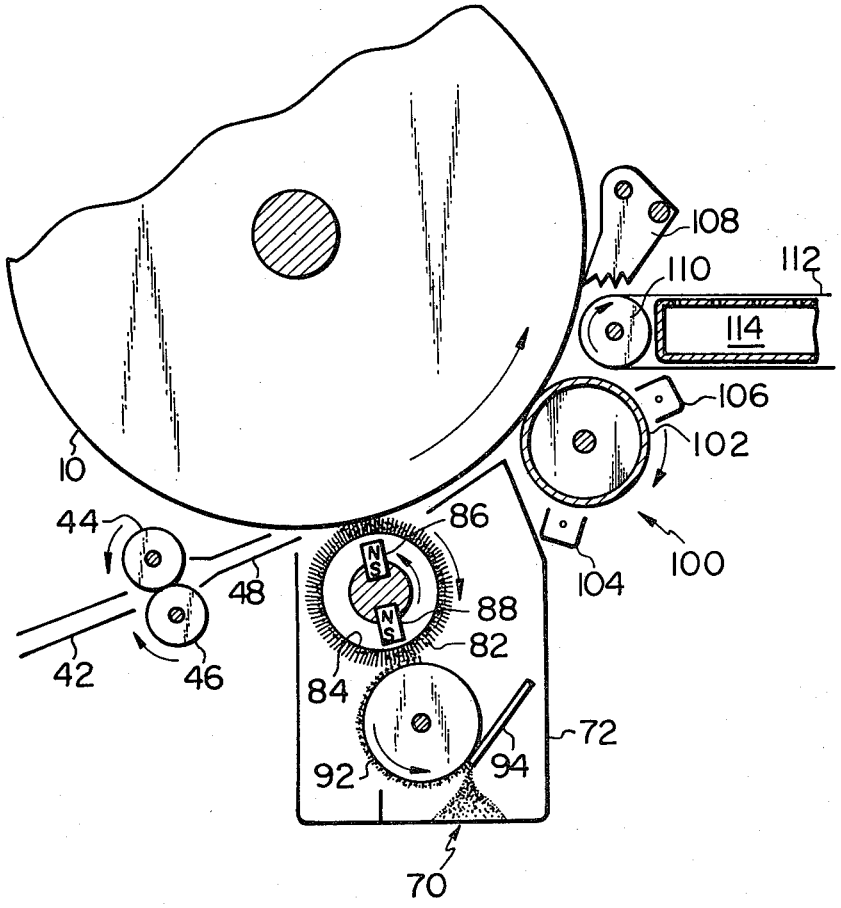
FIG. 2 is a fragmentary schematic view of a second embodiment of the invention.

A second embodiment of the invention is shown in FIG. 2, in which like elements are designated by the same reference numerals. Whereas in the embodiment of FIG. 1 the cleaning unit 70 is disposed between the transfer charging unit 50 and the separating roller 52, in the embodiment of FIG. 2 the cleaning unit 70 is disposed upstream of a transfer roller unit 100. The unit 100 comprises a transfer roller 102 which has an outer surface formed of an electric insulating material and is rotated clockwise in contact with the drum 10.A charging unit 104 applies an electrostatic potential to the roller 102 which is of the same polarity as the potential on the drum 10 to urge the toner image from the drum 10 onto the copy sheets 34 pressed between the drum 10 and roller 102. A discharge unit 106 discharges the roller 102 to maintain the charge thereon uniform. An advantage of this embodiment is that since the magnetic brush 82 contacts the exposed surfaces of the copy sheets 34 prior to the transfer step, the adhesion of the copy sheets 34 to the drum 10 is reduced and made more even. The separating roller 52 is therefore not required, and a separating pawl 108 is sufficient to remove the copy sheets 34 from the drum 10. The copy sheets 34 after removal from the drum 10 are fed by a conveyor comprising a pulley 110 and a belt 112 to a fixing unit. An evacuated box 114 may be provided with holes opening toward the belt 112, with the belt 112 also provided with holes to adhere the copy sheets 34 to the belt 112.

What is claimed is:

1. A method of electrostatography comprising the steps of:

a. radiating a light image onto a photoconductive member to produce an electrostatic image thereon;
b. applying a toner substance to the photoconductive member to develop the electrostatic image into a toner image;
c. pressing a copy sheet against the photoconductive member to transfer the toner image to the copy sheet;
d. producing relative sliding movement between the photoconductive member and a brush in such a manner that the brush slidably contacts an exposed back surface of the copy sheet and a portion of the photoconductive member external of the copy sheet to remove toner substance from said portion; and
e. separating the copy sheet from the photoconductive member.

2. A method as in claim 1, further comprising the step, performed between steps (c) and (d) of:

f. applying an electric potential to the copy sheet to urge the toner substance from the photoconductive member to the copy sheet.

3. A method as in claim 1, further comprising the step, performed between steps (d) and (e), of:

g. applying an electric potential to the copy sheet to urge the toner substance from the photoconductive member to the copy sheet.

4. A method as in claim 1, in which step (d) comprises grounding the brush.

5. A method as in claim 1, in which step (d) comprises applying an electric potential to the brush.

6. A method as in claim 1, in which step (d) comprises applying an alternating electric voltage to the brush.

7. A method as in claim 1, further comprising the step, performed after step (d), of:

h. removing the toner substance from the brush.

8. An electrostatographic apparatus comprising:

a photoconductive member;
imaging means for radiating a light image onto the photoconductive member;
developing means for applying a toner substance to the photoconductive member;
feed means for feeding a copy sheet into contact with the photoconductive member;
brush means for slidably contacting an exposed back surface of the copy sheet and a portion of the photoconductive member external of the copy sheet; and
separator means for separating the copy sheet from the photoconductive member.

9. An apparatus as in claim 8, further comprising transfer charging means for applying an electric potential to the copy sheet for transferring a developed image from the photoconductive member to the copy sheet.

10. An apparatus as in claim 9, in which the transfer charging means is arranged to operate on the photoconductive member and copy sheet after the feed means and before the brush means.

11. An apparatus as in claim 9, in which the transfer charging means is arranged to operate on the photoconductive member after the brush means and before the separator means.

12. An apparatus as in claim 8, in which the photoconductive member comprises a rotary photoconductive drum.

13. An apparatus as in claim 8, in which the brush means comprises a rotary brush.

14. An apparatus as in claim 13, in which the brush means further comprises means for removing toner substance from the rotary brush.

15. An apparatus as in claim 13, in which the rotary brush is a magnetic brush.

16. An apparatus as in claim 15, in which the magnetic brush comprises a non-magnetic cylinder and a magnet disposed inside the cylinder.

17. An apparatus as in claim 16, in which the brush means further comprises means for selectively positioning one of a north and a south pole of the magnet adjacent to the photoconductive member.

18. An apparatus as in claim 16, in which the brush means further comprises a rotary cylinder for removing toner substance from the magnetic brush.

19. An apparatus as in claim 18, in which the brush means further comprises a toner reservoir disposed below the rotary cylinder to retain toner substance removed from the magnetic brush.

20. An apparatus as in claim 18, in which the brush means further comprises a fixed scraper to remove the toner substance from the rotary cylinder.

21. An apparatus as in claim 8, in which the brush means is grounded.

22. An apparatus as in claim 8, further comprising means for applying an electric potential to the brush means.

23. An apparatus as in claim 8, further comprising means for applying an alternating electric voltage to the brush means.

24. An apparatus as in claim 8, further comprising means for selectively moving the brush means into and out of sliding contact with the photoconductive member and copy sheet.

25. A method of electrostatography comprising the steps of:

a. radiating a light image onto a photoconductive member to produce an electrostatic image thereon;

b. applying a toner substance to the photoconductive member to develop the electrostatic image into a toner image;

c. pressing a copy sheet against the photoconductive member to transfer the toner image to the copy sheet, said copy sheet being smaller than the maximum image area of the photoconductive member so that a portion of the photoconductive member external to the copy sheet is not contacted by the copy sheet;

d. producing relative sliding movement between the photoconductive member and a brush in such a manner that the brush slidably contacts an exposed back surface of the copy sheet and said portion of the photoconductive member external of the copy sheet to remove toner substance from said portion; and subsequently, e. separating the copy sheet from the photoconductive member.

26. A method as in claim 25, further comprising removing toner substance from said photoconductive member after the copy sheet has been separated from the photoconductive member.

27. A method as in claim 25, wherein toner substance is applied to the entire photoconductive member.

28. An electrostatographic apparatus comprising:

a photoconductive member;

imaging means for radiating a light image onto the photoconductive member;

developing means for applying a toner substance to the photoconductive member;

feed means for feeding a copy sheet into contact with the photoconductive member, said copy sheet being smaller than the maximum image area of the photoconductive member so that a portion of the photoconductive member external to the copy sheet is not contacted by the copy sheet;

brush means for slidably contacting an exposed back surface of the copy sheet and said portion of the photoconductive member external of the copy sheet to remove toner substance from said portion; and separator means for separating the copy sheet from the photoconductive member after said brush means has slidably contacted said exposed back surface of the copy sheet and said portion of the photoconductive member external of the copy sheet.

29. An apparatus as in claim 28, further comprising cleaning means for removing toner substance from said photoconductive member after the copy sheet has been separated from the photoconductive member.

30. An apparatus as in claim 28, wherein said developing means applies the toner substance to the entire photoconductive member.

* * * * *